US005642667A

United States Patent [19]

Sastre

[11] Patent Number: 5,642,667

[45] Date of Patent: Jul. 1, 1997

[54] STAMPING STRUCTURE

[76] Inventor: Michael Sastre, 4442 Palm Ave., Sacramento, Calif. 95842

[21] Appl. No.: 571,521

[22] Filed: Dec. 13, 1995

[51] Int. Cl.[6] ..... B41K 1/56

[52] U.S. Cl. ..... 101/405; D18/15; 101/406

[58] Field of Search ..... 101/333, 327, 101/405, 406; D18/15

[56] References Cited

U.S. PATENT DOCUMENTS

| | | | |
|---|---|---|---|
| D. 362,455 | 9/1995 | Bowers | D18/15 |
| 1,263,094 | 4/1918 | Millea | 101/405 |
| 3,259,063 | 7/1966 | Rothman | 101/405 |
| 3,973,495 | 8/1976 | Rowe | 101/405 |
| 4,395,948 | 8/1983 | Monich | 101/405 |
| 5,191,837 | 3/1993 | Bolton | 101/333 |

FOREIGN PATENT DOCUMENTS

| | | | |
|---|---|---|---|
| 2517255 | 6/1983 | France | 101/406 |
| 632550 | 11/1949 | United Kingdom | 101/405 |
| 2045687 | 11/1980 | United Kingdom | 101/405 |

OTHER PUBLICATIONS

Samuel H. Moss, Inc.; New York Times advertisement; magazine section 6, p. 76 Nov. 30, 1947.

*Primary Examiner*—John S. Hilten
*Assistant Examiner*—Daniel J. Colilla
*Attorney, Agent, or Firm*—Bielen, Peterson & Lampe

[57] ABSTRACT

A stamping device utilizing a translucent base member having a surface. An imprinting element is fixed to the surface of the base member and is capable of marking items. A handle is also included and possesses a grasping element to allow the user to press downwardly. A translucent connecting structure resiliently links the handle to the base member. The imprinting element is visible through the base member and connecting structure during the stamping process.

8 Claims, 1 Drawing Sheet

FIG-1
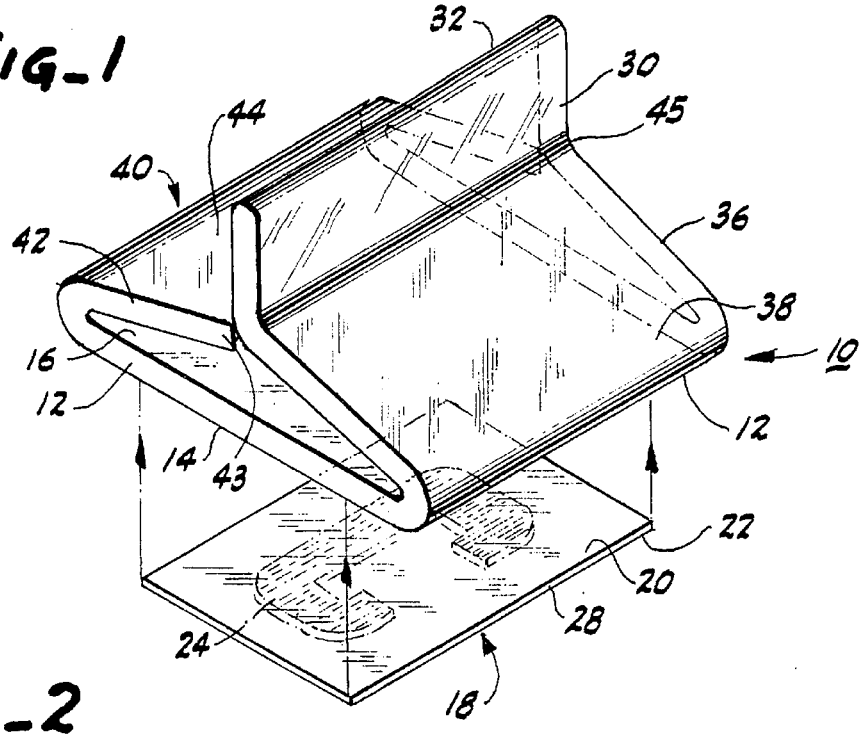
FIG-2
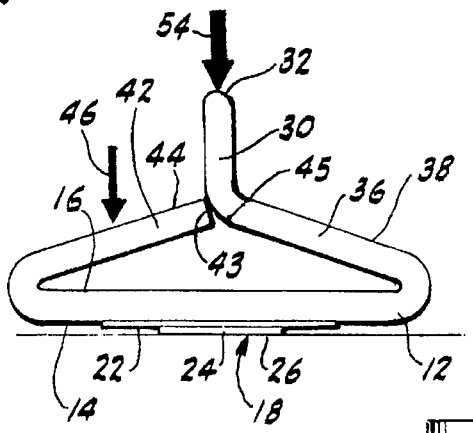
FIG-3
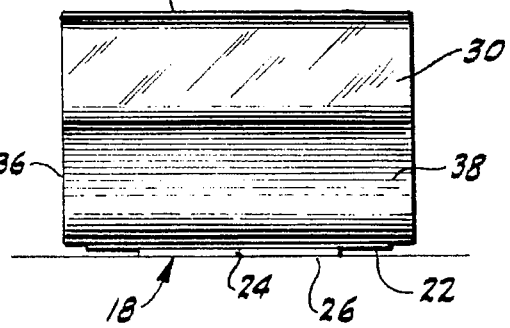
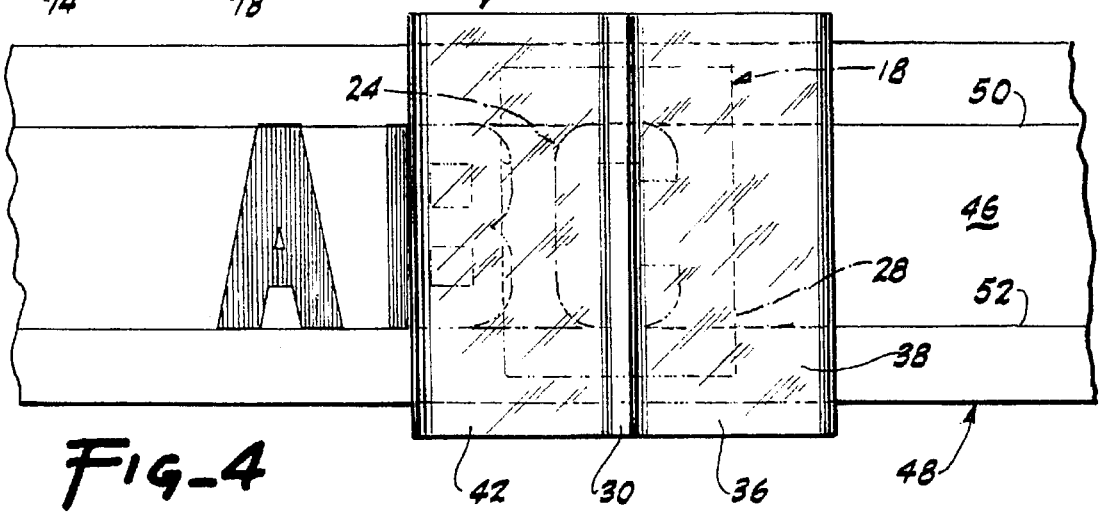
FIG-4

STAMPING STRUCTURE

BACKGROUND OF THE INVENTION

The present invention relates to a novel and useful stamping device.

Stamps or imprinting devices are used extensively to produce impressions on items such as paper, wood, metals, and other surfaces. The advantage of using stamps, instead of manually writing data on these surfaces, is speed and consistency in reproducing a certain impression. Although many stamps have been devised in the past, it is very difficult to accurately align and press a stamp on the surface to be marked without utilizing guides or indicators on the stamp for this purpose.

A stamping device that overcomes the disadvantages of the prior art stamps would be a notable advance in the printing field.

SUMMARY OF THE INVENTION

In accordance with the present invention a novel and useful stamping device is herein provided.

The stamping device of the present invention utilizes a transparent base member having an accessible surface. An imprinting element fixes to the surface of the base member. The imprinting element is capable of carrying marking substances to render the ultimate impression on a surface, which is to be marked by the stamping device.

The imprinting element may be formed with a transparent backing member or plate and a protruding portion which carries the ink or marking substance. Thus, the imprinting element backing member would be connected directly to the surface of the base member, although the protruding portion alone may be fixed directly to the base member. The base member is generally a rigid or semi-riged element, possessing sufficient strength to absorb forces normally associated with a stamping device.

A handle is also found in the present invention and may include a grasping element to permit the user to manipulate the stamping device of the present invention. The handle may take a variety of shapes, including a planar structure which may be located centrally over the base member. The handle may also be formed of translucent or transparent material.

A connecting structure is also employed in the present invention to resiliently link the handle to the base member. The connecting structure may be a translucent element which extends upwardly and inwardly toward the handle lying over the base member. Thus, the imprinting element protruding portion is clearly visible through the base member, handle, and connecting structure.

In certain embodiments, the stamping device of the present invention may take a form where the handle, connecting structure, and base member combine into a continuous unitary structure. Of course, the unitary structure is of translucent configuration to permit one to visibly view the imprinting element on the bottom surface of the base member.

In addition, a translucent flange may be resiliently linked to the base and extend toward the handle in its location over the base member. The translucent flange permits the user to apply a force therealong to even the pressure on the imprinting element connected to the base member. Thus, the resilient connection of the handle to the base member through the translucent connecting structure produces a downward force on the imprinting element, as well as a lateral force on the flange. Consequently, a balanced force takes place on the imprinting element located at the base member bottom surface, In either side of the handle.

It may be apparent that a novel and useful stamping device has been described.

It is therefore a object of the present invention to provide a stamping device which is of generally transparent or translucent configuration to allow the user to accurately position the imprinting portion of the stamp on a surface to be marked.

Another object of the present invention is to provide a stamping device which includes resilient members connected to the imprinting element base that permits the application of force along a perpendicular vector in order to produce a clear impression by the imprinting element of the stamp.

Yet another object of the present invention is to provide a stamping device which is simple and easy to manufacture, yet durable in use.

Another object of present invention is to provide a stamping device which is capable of stamping indicia on a surface accurately and evenly.

The invention possesses other objects and advantages s especially as concerns particular characteristics and features thereof which will become apparent as the specification continues.

BRIEF DESCRIPTION OF THE DRAWINGS

FIG. 1 is a to right perspective view showing the imprinting element in exploded relationship to the remainder of the stamping device of the present invention.

FIG. 2 is an end elevational view of the stamping device of the present invention in use.

FIG. 3 is a side elevational view of the stamping device of the present invention.

FIG. 4 is a top plan view of the stamping device of the present invention during marking of the imprinting portion on a strip of material.

For a better understanding of the invention reference is made to the following detailed description of the preferred embodiments thereof which should be taken in conjunction with hereinbefore described drawings

DETAILED DESCRIPTION OF THE PREFERRED EMBODIMENTS

Various aspects of the present invention will evolve from the following detailed description of the preferred embodiments thereof which should be referenced to the prior described drawings.

The invention as whole is shown in the drawings by reference character 10. Stamping device 10 includes as one of its elements a transparent or translucent base member 12 having a bottom surface 14, FIGS. 1 and 2. Base member 12 may be formed of any suitable material such as plastic, glass, and the like. Top surface 16 is generally oriented in opposite configuration to bottom surface 14.

Imprinting element 18 is depicted in FIG. 1 as being separated from base member 12. Imprinting element 18 includes an upper surface 20 and a lower surface 22. Upper surface 20 is affixed to surface 14 of base member in a centralized location and is generally permanently affixed thereto by any suitable means such as mastic, sonic welding, and the like. Imprinting element 18 also includes a protruding portion 24 which is formed as part of imprinting element 18. Protruding portion 24 extends from lower surface 22 of imprinting element 18 and includes a lower surface 26, which generally carries ink, paint, and other marking materials used in stamping. Imprinting element backing member 28, having surfaces 20 and 22, is transparent or translucent and may be formed of a material such as silicon rubber. Generally, during the stamping process only surface 24 will darken with marking material.

Handle 30 is formed in a vertical planar rectangular solid structure. Handle 30 extends upwardly and includes an upper surface 32 which may be flat or curved. In this regard, handle 30 edge portion may be radiused along all its edges. Handle 30 may be formed of translucent or transparent material similar to base member 12. Translucent connecting structure 36 is also found in the present invention. Structure 36 is resiliently linked to base member 12. Structure 36 includes an upper surface 38 which extends over upper surface 16 of base member 12. Protruding portion 24 of imprinting element 18 is clearly visible when viewed through connecting structure 36, and base member 12. As shown in FIGS. 1–4, base member 12, connecting structure 36, and handle 30 may be formed as a unitary body 40.

Moreover, a transparent or translucent flange 42 may also be included as a portion of the present invention, specifically in unitary body 40. Flange 42 possesses an upper surface 44 through which imprinting element 18 may be viewed. Flange 42 possesses a free end 43 which is capable of contacting bend 45 between handle 30 and structure 36. Again, flange 42 may be formed as a continuous and unitary part of body 40.

In operation, the user grasps stamping device 10 by handle 30 and presses imprinting element, specifically protruding portion 24 thereof, into a marking material or substance such as ink, paint, and the like. Device 10 is then lifted from the marking material and centered on a marking surface such as surface 46 of strip of material 48, FIG. 4. The protruding portion 24 of imprinting element 18 is then viewed through connecting structure 36, flange 42, handle 30, base 12, and backing member 28 of imprinting element 18. Thus, protruding portion 24 may be accurately placed on surface 46. As depicted in FIG. 4, protruding portion 24 of imprinting element 18 is illustrated in the form of a letter "C", lying between lines 50 and 52 on surface 46. It may also be seen that on FIG. 4, the letters "A" and "B" have already been marked between lines 50 and 52 on stamping devices similar to stamping device 10, with the exception of the shape of protruding element 24. That is to say, each protruding element of each device coincides with the letter being marked. Of course, any design or mark may be formed on imprinting element 18 for this purpose. It has been found, that the force applied downwardly, FIG. 2 directional arrow 54 causes connecting structure to flex and produce a downward spring force on protruding portion 24. At the same time, flange 42 edge 43 contacts bend 45 to create a force along directional arrow 47. This force tends to produce an even pressure on protruding element 24. Consequently, the imprints on strip of material 48 are uniformly applied and result in a crisp impression on surface 46 thereof. In addition, the transparency of unitary body 40 permits the user to accurately place the impression on surface 46 of strip 48.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A stamping device comprising:

a. a translucent base member, said base member including a surface;

b. an imprinting element, said imprinting element being fixed to said surface of said base member;

c. a handle, said handle including a grasping element;

d. a translucent connecting structure, said structure resiliently linking said handle to said base member, said handle and said connecting structure being located over said base member, said imprinting element being visible through said base member and connecting member, and e. a translucent flange resiliently linked to said base and extending toward said handle for location over said base member, said imprinting element being visible through said translucent flange, said translucent flange including a surface free of said handle and linked connecting structure, said translucent flange selectively contacting said handle and linking connecting structure upon the application of a predetermined force to said handle.

2. The device of claim 1 in which said base member and connecting structure are formed as a unitary translucent body, said imprinting element being visible through said unitary translucent body.

3. The device of claim 1 in which said base member connecting structure and flange are formed as a unitary translucent body, said imprinting element being visible through said unitary translucent body.

4. The device of claim 1 in which said handle is translucent.

5. The device of claim 1 in which said imprinting element includes a translucent portion and a protruding portion, said protruding portion carrying marking material.

6. The device of claim 5 which additionally comprises a translucent flange resiliently linked to said base and extending toward said handle for location over said base member, said imprinting element being visible through said base member.

7. The device of claim 6 in which said translucent base member, connecting structure, and flange are formed as a unitary translucent body, said imprinting element being visible through said unitary translucent body.

8. The device of claim 7 in which said handle is translucent.

* * * * *